US005884666A

United States Patent [19]

Johnson

[11] Patent Number: 5,884,666

[45] Date of Patent: Mar. 23, 1999

[54] EXHAUST PIPE EXTENSION

[76] Inventor: Nikia Deshawn Johnson, P.O. Box 6413, Jacksonville, Fla. 32236-6413

[21] Appl. No.: 59,585

[22] Filed: Apr. 14, 1998

[51] Int. Cl.[6] ..... F15D 55/00; F01N 1/18

[52] U.S. Cl. ..... 138/39; 138/37; 181/277; D12/194

[58] Field of Search ..... 138/37, 39, 44, 138/109, 103; 181/225, 227–280, 202, 277; D12/194

[56] References Cited

U.S. PATENT DOCUMENTS

| | | | |
|---|---|---|---|
| D. 164,960 | 10/1951 | Russell | D12/194 |
| D. 165,985 | 2/1952 | Koonter | D12/194 |
| D. 181,944 | 1/1958 | Russell | D12/194 |
| D. 189,573 | 1/1961 | Russell | D12/194 |
| 867,973 | 10/1907 | Hoover | 181/277 |
| 1,583,621 | 5/1926 | Steinberg | 181/225 X |
| 2,172,713 | 9/1939 | Rutherford | 181/225 |
| 2,891,580 | 6/1959 | Powers | D12/194 |
| 2,919,720 | 1/1960 | Nicholls | D12/194 |
| 3,000,465 | 9/1961 | Bruno | 181/227 |
| 4,116,269 | 9/1978 | Ikeda | 181/225 X |
| 4,185,688 | 1/1980 | Wiater et al. | 181/225 X |

FOREIGN PATENT DOCUMENTS

| | | | |
|---|---|---|---|
| 503337 | 2/1958 | Italy | 181/277 |
| 26560 | of 1913 | United Kingdom | 181/225 |

*Primary Examiner*—Patrick F. Brinson
*Attorney, Agent, or Firm*—Patent & Trade mark Services; Thomas Zack; Joseph H. McGlynn

[57] ABSTRACT

An exhaust pipe extension having movable fan blades mounted on a center axle which blades and part of the axle extend into an opened vehicle exhaust pipe. The other end of the same axle is fixed connected to a rotatable end decorative visual spinner within a hollow housing. To provide for individuality the visual spinner can take on a variety of different sizes and shapes. The spinner rotates in unison with the propelled fan blades which blades are driven by the vehicle's exhaust gases. Appropriate easily detachable mounts are used to fix the housing and its axle and the fan blade members to the vehicle's exhaust pipe to provide for an attractive add-on accessory.

4 Claims, 2 Drawing Sheets

EXHAUST PIPE EXTENSION

BACKGROUND OF THE INVENTION

The vehicle car accessory market covers a great variety of different items that may be attached to or retrofitted on existing components of the vehicle. For internal combustion engines, at the vehicle's exhaust end such accessories have taken on a variety of different designs and shapes. Normally, such exhaust pipe extensions are mounted to the existing exhaust pipe or may be a complete replacement thereof. In any event, such exhaust pipe extensions impart a different individual distinctive visual appearance to the vehicle or may provide a different audible sound from the exhaust, or both. The present invention relates to an exhaust extension device that is mounted on the opened end of the vehicle's exhaust pipe and which has an internal fan blade driven by the exhaust gases from the engine and an attached visually displayed spinner all as more fully set forth herein.

DESCRIPTION OF THE PRIOR ART

Vehicle accessories that are mounted on or retrofitted to a vehicle's opened exhaust pipe are well known. For example, in U.S. Pat. No. 2,891,580, to Powers a tail pipe spout is disclosed which has V-shaped clamping means or threaded bolts used to hold it to the opened exhaust pipe.

In the Nicholls reference (U.S. Pat. No. 2,919,720) a flexible tail pipe extension is disclosed for use on different shaped exhaust pipes.

The Russell design patent (U.S. Pat. No. Des. 164,960) illustrates a an automobile exhaust pipe extension with bisecting support members in the exhaust having a center cylindrical member.

The Koonter design patent (U.S. Pat. No. Des. 165,985) illustrates a exhaust pipe extension for an automobile have two spaced cylindrical members.

The Russell design patent (U.S. Pat. No. Des. 181,944) illustrates an exhaust deflector with two horizontal and parallel exhaust members.

In the Russell design patent (U.S. Pat. No. Des. 1894,573) there is illustrated an exhaust deflector having surface ridges thereon that terminates near the extension's opened end. The present invention relates to an exhaust extension for a vehicle having a hollow housing mounted near the end of the exhaust pipe with a movable gas driven fan that is operatively connected to a end visual spinner, all as more fully set forth in this specification.

SUMMARY OF THE INVENTION

This invention relates to an exhaust pipe extension having a movable fan mounted within the exhaust pipe and connected to a rotatable end visual spinner. The visual spinner can take on a variety of different sizes and shapes and rotates in unison with the propelled fan driven by the exhaust gases.

It is the primary object of the present invention to provide for an improved vehicle exhaust extension having a gas driven fan attached to rotate in unison with a connected spinner.

Another object is to provide for such an exhaust extension wherein there are internal frame supports for the connection between the fan and the spinner and means to mount a containing housing to the exhaust pipe.

These and other objects and advantages of the present invention will become apparent to readers from a consideration of the ensuing description and the accompanying drawings.

DESCRIPTION OF THE PREFERRED EMBODIMENT

Figure 1:
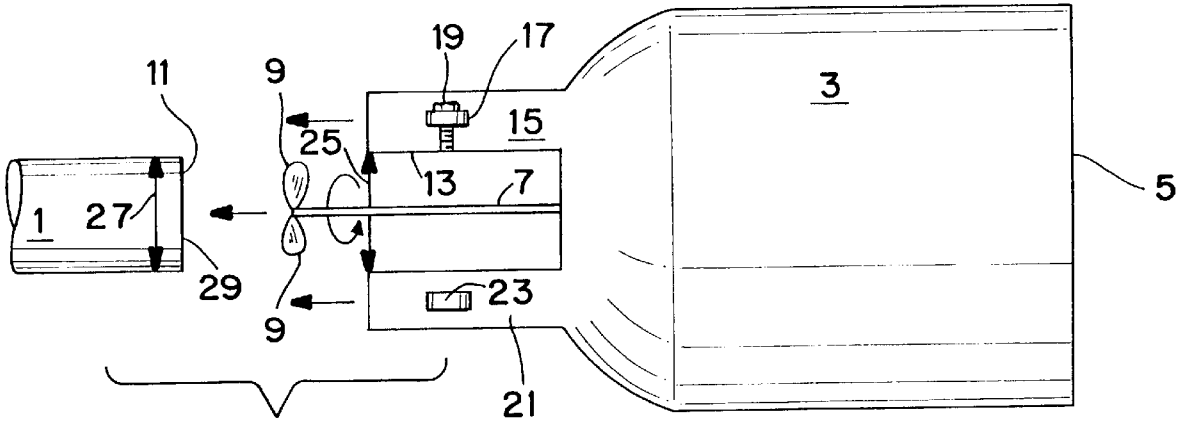
FIG. 1 is a side view of the invention's preferred embodiment as it is being mounted on a vehicle's exhaust pipe.

FIG. 1 is a side view of the invention's preferred embodiment as it is being mounted on a vehicle's open ended exhaust pipe 1. The invention has a hollow housing 3 with a larger opened front end 5, a rotatable axle 7 mounted longitudinally in the center of the housing, and end fan blades 9 fixed to the back or rear end of axle 7. The fan blades 9 are sized to fit within the hollow opened end 11 of the exhaust pipe and extend with part of the axle into the opened end of the exhaust pipe a fixed distance.

Fixed to outer housing 3 is an end extension 13 consisting of two spaced members joined to the main housing 3 with an opened space between the spaced members. On the outside of the upper extension member 15 there is an outwardly protruding surface element 17 fixed to the housing having a vertical threaded hole extending through it. A threaded bolt 19 is threadly received in this threaded hole. On the surface of the lower housing extension member 21 there is protrusion element 23, similar to element 17, fixed to the extension but without a threaded through hole.

The distance 25 between the two extension housing members is just slightly greater than the exhaust pipe's outside diameter 27 such that the two extension members may be slid over the exhaust pipe and fixed thereto when lower protrusion member 23 rests on the lower outside surface of the exhaust pipe and upper protrusion member 17 engages the upper outside surface of the exhaust pipe. The extensions may be curved in cross section to configure to the shape of the exhaust pipe. By tightening down on the threaded bolt 19, the bolt's end will contact the upper surface of the exhaust pipe and firmly hold the housing 3 and its extension members on the exhaust pipe.

While the end extension of the housing is being connected on the exhaust pipe, the end fan blades 9 adjacent part of axle 7 are inserted into the opened exhaust pipe. As the vehicle's engines emits exhaust gases 29 the inserted freely rotatably mounted fan blades 9 will begin rotating. This causes the connected axle 7 to rotate in unison with the rotating fan blades.

Figure 2:
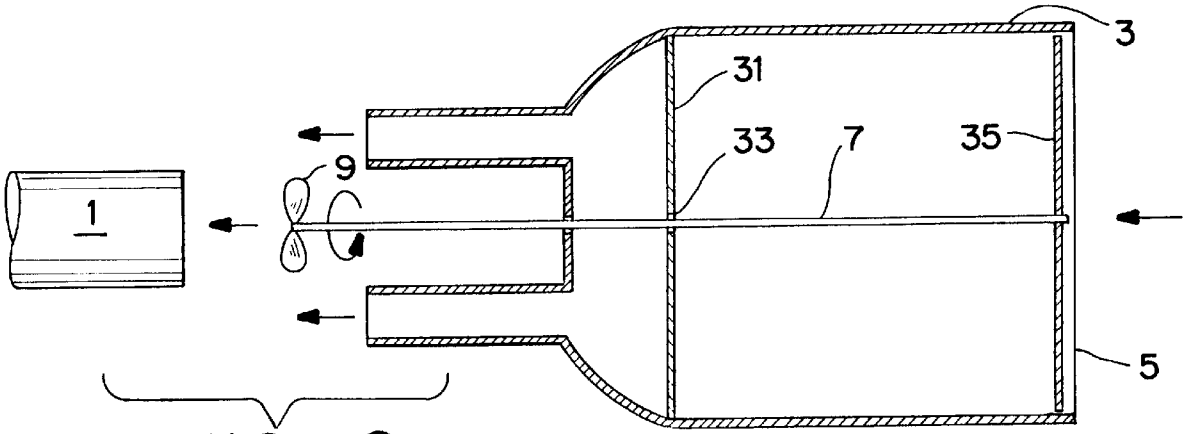
FIG. 2 is a cross sectional side view taken along line A—A of FIG. 3.
Figure 3:
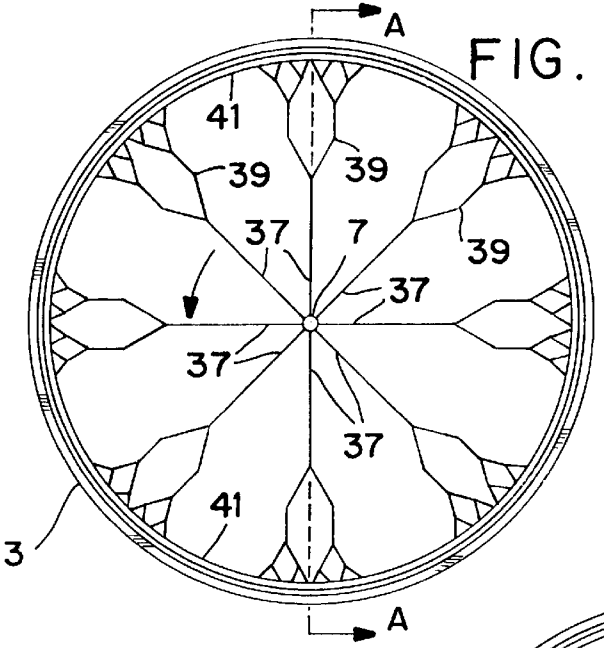
FIG. 3 shows a front view of one type of visual spinner that could be used.

FIG. 2 is a cross sectional side view taken along the center line A—A of the FIG. 3 front view. Within the hollow housing 3 is the center mounted axle 7 with its rear mounted fan blades 9. A rigid support rod 31 fixed at its ends to the internal walls of the housing spans the diameter of the housing and has a center axle journal 33 where the support rod meets the rotatable axle 7. The journal encircles the axle and firmly hold it in place with respect to the housing while allowing the axle's free rotation in the journal. At the forward end of the axle is a center fixedly attached visual chrome spinner 35 which can rotate in unison with the axle 7 within the confines of the hollow housing 3.

FIG. 3 shows a front view, as viewed in the direction of the arrow in FIG. 2 near the opened front housing end 5, of one type of visual spinner 35 that could be used. The spinner's outside circular rim 41 is slightly less in outside diameter than the inner diameter of the hollow housing 3 such that the spinner can freely rotate therein on axle 7. In the particular spinner design depicted in FIG. 3, there are eight spaced leg spokes 37 members extending outwardly from the axle's 7 front end with a series of outer decorative members 39 fixed to both the outside circular rim 41 and the supporting individual leg spoke members 37.

Figure 4:
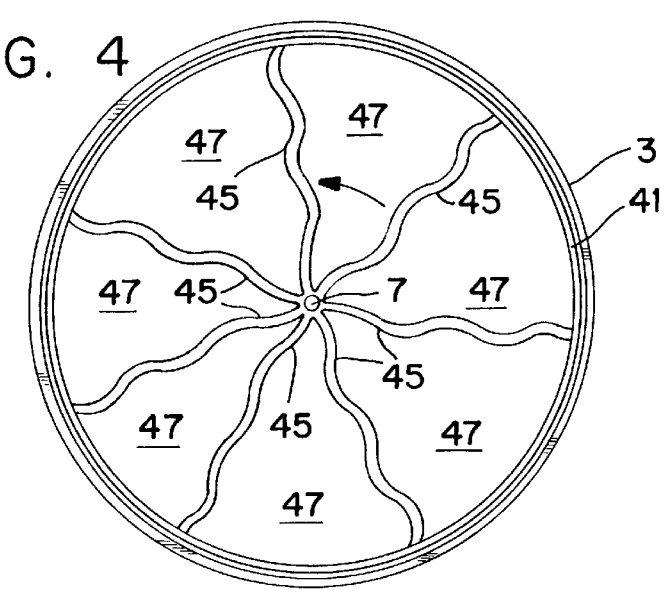
FIG. 4 shows a front view of an other type of visual spinner that could be used.

FIG. 4 shows a front view of another type of visual spinner 43, as viewed in the direction of the arrow in FIG. 2 near the opened front housing end 5, that could be used with the FIGS. 1–2 embodiment. The outside circular rim 41 joins each of the undulating individual spoke spinner members 45 to the center axle 7 with considerable open space 47 between the spinner members. Thus, in this embodiment the visual spinner is mostly open space with a few spoke members extending from the axle to the circular encircling rim 41.

Figure 5:
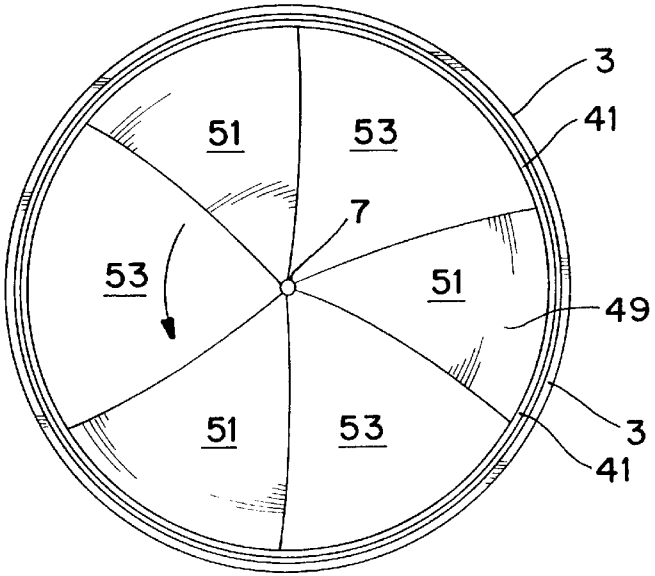
FIG. 5 shows a front view of still another type of visual spinner that could be used.

FIG. 5 shows a front view of still another type of visual chrome spinner 49, as viewed in the direction of the arrow in FIG. 2 near the opened front housing end 5, that could be used with the FIGS. 1–2 embodiment. In this particular spinner embodiment the spinner consists of three somewhat triangular shaped solid members 51 joined at their center apexes to the center axle 7 and at their outer edges to the encircling circular rim 41. About half of the spinner is occupied by opened intervening alternative spaces 53 in this embodiment with the other half being the alternating solid spaced members 51. Clearly, other designs can be used for the chrome spinners in addition to those illustrated. Customizing the spinner's design to the particular desires of the user is highly desirable.

The axle attached spinner rotates as the fan blades encounter the moving exhaust gases from the vehicle's engine. Since, the blades, axle and spinner are joined together they move in unison under this propelling force of discharged gases. The visual spinner does not have to have an aerodynamic shape since the force to rotate it comes from its attachment to the axle and fan blades not the spinner's shape. The number of fan blades 9 on the axle's rear end can vary as desired from two to four or more.

It is important that the housing extensions be easily removably attached to the gas emitting exhaust of a vehicle. Using a threaded bolt, as shown, or any other easily accessible and attachable device, such as a clamp, is preferred. With an easy-off or on attachment means the invention may be placed as an add-on accessory on any vehicle exhaust desired as long as the exhaust is capable of emitting exhaust gases to rotate the fan blades or removed from the same exhaust should the need arise. Different diameter for the housing can be manufactured to accommodate different outside diameters for different vehicles.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An exhaust pipe extension in combination with the exhaust pipe of a vehicle comprising:

a hollow vehicle exhaust pipe for supplying a source of engine exhaust gases there through, said exhaust pipe having an opened end;

a hollow housing having front and rear ends with the rear end of the housing being detachably mounted on said vehicle exhaust pipe;

an axle having front and rear ends mounted within said housing with fan blades located near of the rear end of said axle, said fan blades being fixed to the axle and said axle and its fan blades extending into said exhaust pipe;

said axle having a visual spinner fixed to the axle's front end remote from the fan blades, said spinner being mounted within the front end of hollow housing so as not to extend therefrom; and threaded bolt means for removably attaching the hollow housing on the exhaust pipe of a vehicle near the exhaust pipe's opened end.

2. The apparatus as claimed in claim 1, wherein said visual spinner is fixed to the axle at one end and has an encircling circular rim at the spinner's outer edge.

3. The apparatus as claimed in claim 2, wherein said visual spinner consists mainly of opened alternating spaces between decorative undulating spoke members.

4. The apparatus as claimed in claim 2, wherein said visual spinner consists of about alternating half opened spaces and about half alternating solid members, said solid members being fixed to the axle and extending to and fixed on the circular rim.

* * * * *